United States Patent [19]

Williams

[11] Patent Number: 4,949,796

[45] Date of Patent: Aug. 21, 1990

[54] DRILLING HEAD SEAL ASSEMBLY

[76] Inventor: John R. Williams, Box 6155, Fort Smith, Ark. 72906

[21] Appl. No.: 320,288

[22] Filed: Mar. 7, 1989

[51] Int. Cl.[5] ..... E21B 33/068

[52] U.S. Cl. ..... 175/209; 175/214; 166/88

[58] Field of Search ..... 175/214, 209, 213, 210, 175/207, 218, DIG. 423; 166/82, 84, 88, 89; 277/31

[56] References Cited

U.S. PATENT DOCUMENTS

| | | | |
|---|---|---|---|
| 2,170,916 | 8/1939 | Schweitzer et al. . | |
| 2,176,355 | 10/1939 | Otis . | |
| 2,583,497 | 1/1952 | Schweitzer . | |
| 2,760,795 | 8/1956 | Vertson . | |
| 2,846,247 | 8/1958 | Davis . | |
| 3,029,083 | 4/1962 | Wilde . | |
| 3,052,300 | 9/1962 | Hampton . | |
| 3,128,614 | 4/1964 | Auer . | |
| 3,387,851 | 6/1968 | Cugini . | |
| 3,400,938 | 9/1968 | Williams | 277/31 |
| 3,503,617 | 3/1970 | Williams | 277/9 |
| 3,868,832 | 3/1975 | Biffle | 166/82 |
| 3,965,987 | 6/1976 | Biffle | 166/315 |
| 4,157,186 | 6/1979 | Murray et al. . | |
| 4,285,406 | 8/1981 | Garrett et al. | 175/195 |
| 4,304,310 | 12/1981 | Garrett | 175/195 |
| 4,312,404 | 1/1982 | Morrow | 175/214 |
| 4,383,577 | 5/1983 | Pruitt | 166/95 |
| 4,398,599 | 8/1983 | Murray | 166/82 |
| 4,406,333 | 9/1983 | Adams | 166/84 |
| 4,423,776 | 1/1984 | Wagoner et al. | 166/84 |
| 4,428,592 | 1/1984 | Shaffer | 277/230 |
| 4,486,025 | 12/1984 | Johnston | 277/31 |
| 4,526,243 | 7/1985 | Young | 175/195 |
| 4,621,403 | 11/1986 | Babb et al. | 29/433 |
| 4,754,820 | 7/1988 | Watts et al. | 175/195 |
| 4,783,084 | 11/1988 | Biffle | 166/82 |

*Primary Examiner*—Stephen J. Novosad
*Assistant Examiner*—Terry Lee Melius
*Attorney, Agent, or Firm*—Arnold, White & Durkee

[57] ABSTRACT

There is disclosed an improved drilling head which provides for the formation of a continuous seal about a drilling string, where the drilling string consists of varying diameter drill string components. A stationary bowl configured to pass a drill string is provided with an annular grove about the top so as to allow for the attachment of a connecting clamp. An assembly carrier is provided which is removably disposable within the bowl and to which a lower stripper rubber may be attached. A bearing assembly adapted for placement within the assembly carrier is provided with an upper rotatable stripper rubber of smaller diameter that the lower stripper rubber so as to form a seal on smaller diameter drilling strings.

5 Claims, 2 Drawing Sheets

DRILLING HEAD SEAL ASSEMBLY

BACKGROUND OF THE INVENTION

1. Field of the Invention

The present invention generally relates to an improved drilling head which provides for the formation of a continuous seal about a drilling string, where said string consists of varying diameter drill string components. More particularly, the present invention is directed to a drilling head provided with stationary and rotatable sealing elements, which elements provide for continuous seal integrity about both drill pipe and collars while allowing ease of removal.

2. Background

Oil, gas, water and geothermal wells are drilled with a drill bit attached to a hollow drill string which passes down through a well casing installed in the well bore. A drilling head is usually attached to the top of the well casing or other blowout control equipment where it emerges from the ground to seal the interior of the well casing from the surface and thereby permit the forced circulation of drilling fluid or gas during drilling operations. In the more commonly used forward circulation drilling mode, the drilling fluid or gas is pumped down through the interior of the hollow drill string, out the bottom thereof, and upward through the annulus between the exterior of the drill string and the interior of the well casing and then out the drilling string side outlet. In reverse circulation, the drilling fluid, gas or air is pumped down the annulus between the drill string and the well casing and upward through the drill string.

Prior art drilling heads often have included a stationary body which carries a rotatable spindle that is rotated by a kelly driving the rotary drilling operation. A seal or packing, often referred to as a stripper packer or stripper rubber, is carried by the spindle to seal the periphery of the kelly or the sections of the drill pipe, whichever is passing through the spindle, and thereby confine the fluid pressure in the well casing and prevent the drilling fluid, whether liquid or gas, from escaping between the rotary spindle and the drill string.

Numerous stripper packers have been developed to provide rotational and slideable sealing of the drill string within the drilling head. The rotation of the kelly drill string, the frequent upward and downward movement of the kelly and the drill string during addition of drill pipe sections, and the pressures to which the drilling head is subjected, demand that the packing components of the drilling head be able to withstand continuous use without sacrificing seal integrity about the drill string.

As modern wells achieve ever greater depths, greater temperature and pressure are encountered, promoting the presence of high temperature, high pressure steams or water vapor at the drilling head. Such rigorous drilling conditions pose increased risks to rig personnel from accidental scalding, burns, or contamination with well fluids.

A variety of drill heads have been developed to address these problems of increasing temperatures and pressures. One such drilling head incorporates a rotatable stripper rubber which is placed above a stationary stripper rubber, where the upper, rotatable stripper rubber has a smaller inside diameter than the stationary rubber. In such a design, a seal is maintained against the incursion of steam or high temperature water when tripping the drill string out of the well, since a seal is constantly maintained for both the drill pipe and the drill collars.

Such prior art drilling heads, however, had a number of disadvantages. One such disadvantage is the cumbersome and time-consuming operation which was required to change the sealing components, e.g. the stripper rubbers. In prior art designs, the larger stationary rubber required a time intensive operation to unbolt or rebolt the rubber in the drilling head bowl. Further, such operation posed considerable hazard to rig personnel in the event steam or hot water bypassed a closed valve below the bowl. Further, such unbolting operations often resulted in the loss of a wrench or bolts into the well, thus requiring expensive removal.

Removal and replacement of the unbolted stripper rubbers is also tedious in prior art heads. Removal often required the use of a cat line and removal tool to unseat the rubber. Replacement of the rubber involved a similar time-consuming operation.

SUMMARY OF THE INVENTION

The present invention addresses the above noted and other disadvantages by providing a drilling head which allows for ready installation and removal of sealing components while maintaining seal integrity about the drill string.

The present invention is addressed to a geothermal drilling head which is provided with a rotatable stripper rubber which is positioned above a stationary stripper rubber in a fixed vertical relationship. The head itself includes a tubular bowl which accommodates a removable assembly carrier, which in turn accommodates a removable, bearing assembly. The assembly carrier is threadedly coupled to the stationary drill collar rubber and is detachable from the bowl preferably via a clamp. The bearing assembly carries the rotatable drill pipe rubber in an upper clamp or similar fastener.

The present invention has a number of advantages over the art. One such advantage of the present invention is the ease of which access and replacement of the sealing members is provided.

A second advantage of the present invention is its adaptability to a well bore of infinite size by the simple construction of an assembly carrier having a larger outside diameter and a larger inside bore when necessary.

DETAILED DESCRIPTION OF PREFERRED EMBODIMENT

Figure 1B:
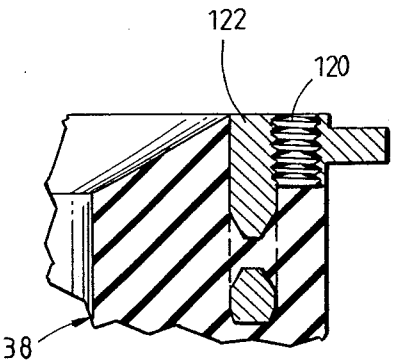
FIG. 1B illustrates a detailed cross-sectional view of the stationary stripper rubber as it may be attached to the assembly carrier.
Figure 1A:
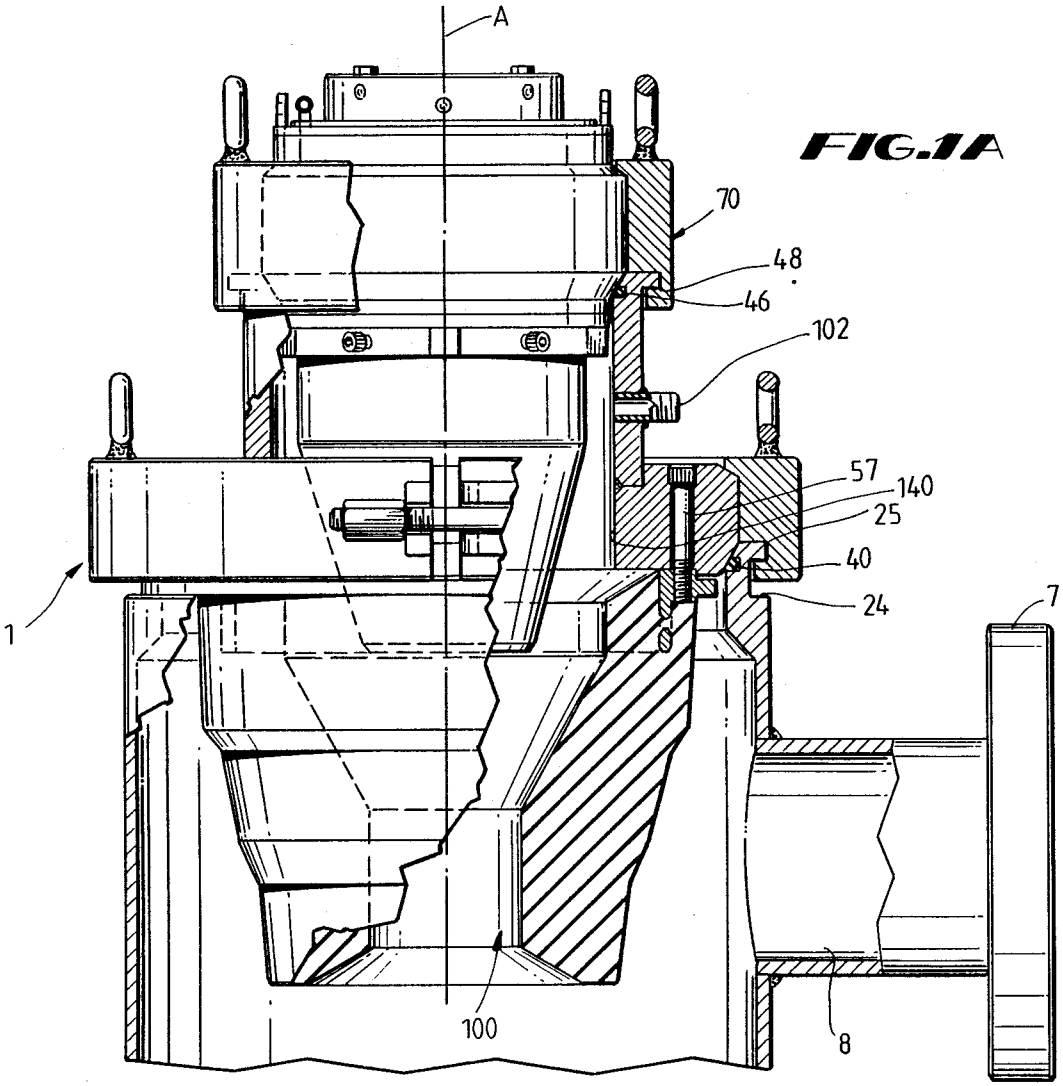
FIG. 1A illustrates a side cross section view of the drilling head of the present invention.
Figure 2:
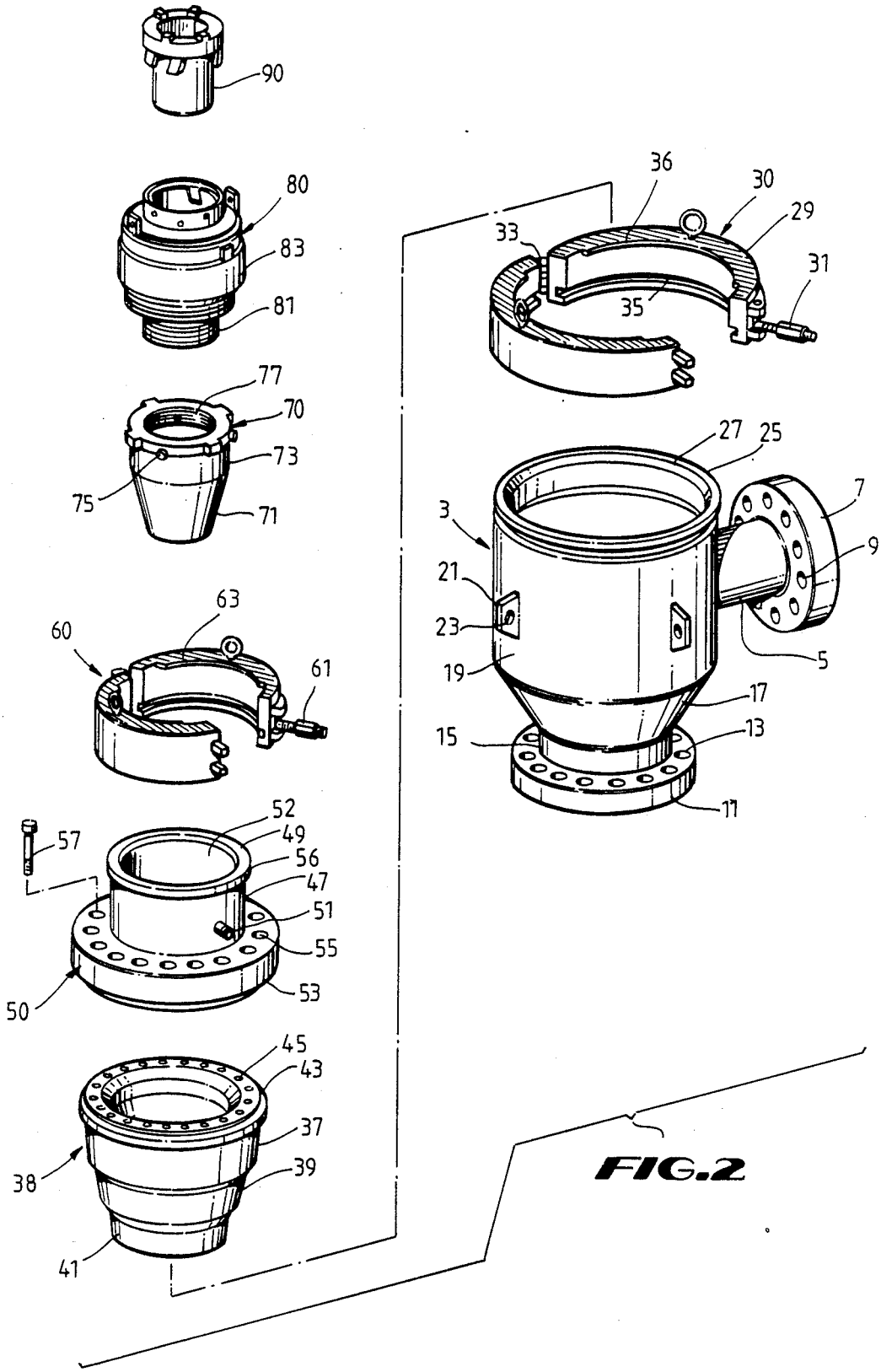
FIG. 2 illustrates an exploded view of the individual components of the claimed drilling head, including the assembly carrier.

Referring to the drawings and especially FIGS. 1A and 2, shown therein is a drilling head assembly 1 constructed in accordance with the present invention. Drilling head 1 includes a stationary housing or bowl 3, having an upper end 19 and a lower end 15. An axial bore 100 extends through the housing 3 from the upper end to the lower end. Restated, axial bore 100, substantially symmetrical about longitudinal axis A, extends through housing 1 so as to accommodate a drill string (not shown). The lower end 15 of bowl 3 has a flange 11 provided with a bolt circle 13 which is configured to mate with a similarly configured flange attached to the uppermost end of the well bore casing (not shown) or blowout preventer (not shown) and attached thereto via appropriately sized fasteners (also not shown).

Housing or spool 3 is provided with an exiting fluid port 8 defining a communicating outlet conduit 5 which is affixed to the outer wall of housing 3. Outlet conduit 5 is preferably provided with a flange 7 at its distal end which is designed to mate with a similarly configured flange at the end of a fluid transporting conduit (not shown). Appropriately sized fasteners (not shown) extending through bolt circle 9 of flange 7 may be used to secure it to the fluid transporting conduit (not shown).

An annular recess or groove 24 is formed about the upper end 19 of spool 3, said groove defining a lip 25. Preferably, lip 25 is provided with a beveled interior sealing surface 27 to accommodate the assembly carrier as will be further described herein.

In preferred embodiments, spool 3 may be provided with lifting brackets or tie-down ears 23 to aid in placement of spool above the blowout preventoer, well casing, etc.

The assembly carrier 50 is adapted to be sealingly disposed inside bowl 3 in a manner illustrated in FIG. 1A. In a preferred embodiment, assembly carrier 50 comprises an upper end 47 and a larger diameter lower end 53, said lower end 53 defining a bolt circle 55 which is configured to attach to the upper end of a stationary drill collar rubber 38 as will be discussed further herein. In preferred embodiments, the upper end of assembly carrier 47 is provided with a bleeder port 51. Bleeder port 51 allows for the release of pressure accumulating between drill collar rubber 38 and drill pipe rubber 70.

Stationary rubber 38 is provided with a bolt ring 45 about its outer periphery corresponding to the bolt ring 55 provided on assembly carrier 50. In such a fashion suitable fasteners, such as bolts 57, may secure assembly carrier 50 and stationary rubber 38 in a fixed relation. Bolt rig 55 is preferably preformed of a sturdy metalic material and molded into rubber 38. In such a fashion, maximum structural integrity may be achieved.

Stationary rubber 38 is preferably secured to assembly carrier 50 by the use of fasteners 57 as described above. Preferably, fasteners are of an appropriate size such that when threadedly secured to carrier 50, a space or gap remains in the bolt ring above said fasteners 57. Preferably, a pipe plug (not shown) is secured over fasteners 57 into bolt ring 55. In such a fashion, fasteners are inhibited from vibrating loose. Further, the presence of pipe plugs also presents, or at least inhibits, the passage of fluid or gas around fastners 57. In alternate embodiments, both assembly carrier 50 and stationary rubber 38 may be provided with threads or the like to allow for their connection.

As illustrated, stationary rubber 38 is preferably comprised of a series of concentrically distending radial segments, each downwardly distending segment being of smaller diameter.

Assembly carrier 50 is adapted to be secured to bowl 3 via clamping assembly 30. Assembly 30 is a generally doughnut shaped member which comprises two half members pivotally interconnected at one set of ends and boltingly interconnectable at the other end via bolt 31. The clamping assembly is of conventional design so that further detail need not be provided; it is sufficient for the purpose of this disclosure to state that the clamping assembly 30 is a selected one of many available clamping mechanisms which can serve to removably clamp the assembly carrier, including stripper rubber 38, to spool 3 via the protruding lip 25 and recess portion 24 of spool 1 and the protruding lip 43 of carrier 38. Preferably, the profile of clamping assembly 30 will overlap the outline of the protruding lip 25 and 43 in a manner similar to that depicted in FIG. 1A.

Bearing assembly 80 preferably comprises a body of sturdy metal construction designed for attachment to upper stripper rubber 70 while being receivable within the axial bore 140 of the assembly carrier 38 as shown in FIG. 1A. Bore 140 extends upward through bearing assembly 80 so as to allow the passage of a drill string therethrough. A downwardly depending shank 84 is provided with male threads 81 to enable threaded connection with corresponding female threads 77 of the upper stripper rubber 70. Preferably, shank 84 is provided with left hand threads so as to be self-tightening upon rotation of kelly 90. To further ensure a secure connection between upper rubber 70 and bearing assembly 80, set screws 75 may be driven through the shoulder 73 of rubber 70 into shank 84.

As noted, bearing assembly 80 and upper stripper rubber 70 are adapted to be rotatably received within bore 140 of the bowl gasket portion 52 of assembly carrier 50. Assembly carrier 50 is preferably connected to bowl 52 via a clamping assembly 60 as earlier described. Preferably, the profile of clamping assembly 60 will overlap the outline of the protruding lip 56 and annular flange 83 as shown in FIG. 1A.

In assembled form, the drilling head assembly 3 provides a seal between a rotating drilling kelly 90 and the upper well head casing such that drilling fluid, steam or water rising from the well bore will be diverted as to exit the outlet conduit 5. Once the tool string is completed, the kelly 90 is disposed such that it is seated above and within bearing assembly 80. As the kelly 90 is drivingly rotated, the upper stripper rubber 70 is rotated therewith, along with the bearing assembly 80.

Should it be necessary to repair or replace the drill bit or effect an inspection of the drill string, the invention provides a constant seal around varying diameter elements of the drill string. In such a fashion, when drilling is underway a seal is maintained against the drill pipe by the rotating upper stripper rubber. However when larger diameter pipes or collars are removed from the well bore, a seal is still maintained about the drill string by the presence of stationary rubber 38.

In operating the apparatus, a lower stripper rubber is first bolted onto the assembly carrier. The assembly carrier, with lower stripper rubber attached, is then lowered into the bowl and the large clamp is closed so as to lock the assembly carrier into proper position within the bowl. The drill bit is then lowered through the lower stripper rubber until the diameter of the drill string becomes too small and the lower stripper rubber is unable to seal around the smaller pipe. When this occurs, the clamp on the assembly carrier is opened and the upper stripper rubber and corresponding bearing assembly are installed. The upper stripper rubber will then seal on the smaller pipe due to the smaller diameter associated with the upper stripper rubber.

The operational process is reversed during withdrawal from a hole and thus a constant seal is maintained regardless of pipe diameter.

Should it become necessary to repair or remove either the upper or lower stripper rubber, it will be recognized that the present invention allows for such removal with a minimum of risk to rig personnel, while yet allowing for ease of operation.

Removal of the upper stripper rubber is a simple task since the rubber is attached to the bearing assembly. Thus to repair or replace the upper stripper rubber, the bearing assembly, with the attached rubber, is lifted from the bowl leaving the lower stripper rubber to maintain a seal. The upper stripper rubber may thereafter be removed and replaced or repaired and reinstalled. Sine the lower stripper rubber is attached to the assembly carrier it may be easily installed or removed from the bowl by simply lowering or raising the assembly carrier.

Upper stripper rubber 70 is preferably provided with a tapered sealing surface 71. While the presently perferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. A drilling head comprising:

a tubular spool having an opening therethrough, an assembly carrier removably disposed in said spool opening and having a passage through which a drill string drive tube may extend;

a bearing means rotatably positioned along said assembly carrier in a fixed yet removable relation therewith;

a first downwardly converging seal means coupled to and rotatable with said bearing means and adapted to rotate in sealing engagement with the drive tube of the drill string;

a second downwardly converging seal coupled to said assembly carrier and adapted to sealingly engage the drill string as the seal remains in a stationary orientation relative to said drill string;

said first seal means having a seal opening of smaller diameter than said second seal means;

and wherein said bearing assembly and said first seal means may be removed while said second seal means maintains sealing engagement with said drill string.

2. The drilling head of claim 1 wherein an annular space is defined between the first and second sealing means when positioned in relative orientation inside said tubular spool.

3. A drilling head comprising:

a tubular spool having an opening therethrough;

an assembly carrier removably disposed in said spool opening in a fixed vertical orientation in said spool, said assembly carrier having a passage through which a drill string may extend, said assembly carrier provided with a stationary stripper rubber about its base, said rubber adapted to sealingly engage said drill string;

a bearing means rotatably and removably positioned above said assembly carrier in fixed vertical position relative thereto, said bearing means provided with a rotatable stripper rubber coupled thereto, said rubber adapted to rotate in sealing engagement with said drill string, the combination stationary and rotatable stripper rubber defining an annulus therebetween when coupled in operative relationship inside said spool and wherein said bearing means and said rotatable stripper rubber may be removed while said stationary stripper rubber maintains sealing engagement with said drill string.

4. The drilling head of claim 3 wherein said stationary stripper rubber is provided with a seal opening of larger diameter than said rotatable stripper rubber.

5. An improved drilling head assembly for a well bore, comprising:

stationary housing having an upper and a lower end, an axial bore extending through the housing from the upper end to the lower end and configured to receive therethrough a rotating driving member, the housing having an inner sealing surface;

an assembly carrier removably coupled to a first stripper means, via a stripper fastener means, the combination disposable within the axial bore for facing a fluid passage seal between the driving member extended through the axial bore and the inner sealing surface of the housing;

a bearing means removably coupled to a second stripper means, the combination removably disposed within the assembly carrier, said bearing means and second stripper means rotatable with said driving member and adapted for forming a fluid passage seal between said driving member and the assembly carrier;

first clamping means for removable securing the stationary housing to the assembly carrier and a second clamping means for securing the assembly carrier to the bearing means, where said stripper fastening means allow the disassembly and reassembly of said bearing assembly and said second stripper means while said first stripper means remains situated in sealing contact with said stationary housing.

* * * * *